US010088260B1

(12) United States Patent
Badanin

(10) Patent No.: US 10,088,260 B1
(45) Date of Patent: Oct. 2, 2018

(54) BULLET SUPPRESSOR

(71) Applicant: Yury Badanin, Vancouver, WA (US)

(72) Inventor: Yury Badanin, Vancouver, WA (US)

( * ) Notice: Subject to any disclaimer, the term of this patent is extended or adjusted under 35 U.S.C. 154(b) by 0 days.

(21) Appl. No.: 15/904,510

(22) Filed: Feb. 26, 2018

(51) Int. Cl.
*F41A 21/30* (2006.01)
*F41A 5/02* (2006.01)

(52) U.S. Cl.
CPC ..... *F41A 21/30* (2013.01); *F41A 5/02* (2013.01)

(58) Field of Classification Search
CPC ..... F41A 21/30
USPC ..... 89/14.4
See application file for complete search history.

(56) References Cited

U.S. PATENT DOCUMENTS 658,934 A * 10/1900 Washington et al. ... F41A 21/30 89/14.4
1,763,286 A * 6/1930 Zygmunt ..... F41A 21/30 137/614.17
1,773,443 A * 8/1930 Zygmunt ..... C09B 49/10 89/14.4

FOREIGN PATENT DOCUMENTS

WO WO-2016046190 A1 * 3/2016 ..... F41A 21/28

* cited by examiner

*Primary Examiner* — Stephen Johnson

(74) *Attorney, Agent, or Firm* — Nadya Reingand; Yan Hankin

(57) ABSTRACT

A bullet suppressor for lowering the decibel level of a fired bullet from a firearm is disclosed. The effect of the suppressor is the trapping of exhaust gases trailing a bullet, such that the bullet exits the suppressor but the exhaust gases remain within the suppressor. This effect is achieved by the interaction of two levers within the suppressor, which are influenced every time a bullet is fired. As a bullet travels through the barrel of the suppressor, a first lever is forced to rotate in a first direction, causing a second lever to rotate in an opposite direction until it creates a boundary which traps exhaust gases exiting the firearm because they reach the end of the suppressor barrel. Other mechanical elements are also disclosed for more intricate systems within the suppressor. The trapping of the gases significantly reduces the sound of the gunshot.

9 Claims, 4 Drawing Sheets

BULLET SUPPRESSOR

FIELD OF THE INVENTION

This invention relates generally to the field of bullet suppressors, and particularly to suppressors for handheld firearms.

BACKGROUND OF THE INVENTION

Protecting one's hearing from loud sounds has become increasingly important as research into hearing loss reveals exposure to loud sounds over a prolonged period of time may be more detrimental to hearing than originally contemplated. As a consequence, perhaps nowhere is the need for hearing protection more apparent than in the sport of recreational shooting.

While many recreational shooters utilize earplugs or protective earmuffs to safeguard their hearing, such devices may be uncomfortable or prevent the user from hearing other sounds he or she may desire to hear, such as music, conversation with friends, or evening a warning of danger. As such, many shooters of today have begun to turn to firearm suppressors as a means of protecting their hearing without resorting to earplugs or protective earmuffs. In fact, although suppressors, also known as silencers, were perceived by the public at large as a tool of a hitman or other unsavory character, they are now becoming embraced as an acceptable tool for the shooting enthusiast who is seeking to lower his or her exposure to loud and harmful noise.

Consider for instance that many common handguns and rifles generate sound levels of one hundred fifty to one hundred sixty decibels (150-160 dB) in magnitude, a level that far exceeds the ear damaging threshold of one hundred forty decibels (140 dB). While there are likely exceptions, most widely available suppressors limit handgun and rifle noise to about one hundred ten to one hundred twenty decibels (110-120 dB), a level most people would still find uncomfortable. Additionally, most suppressors must be fitted onto the end of a handgun or rifle barrel and this usually requires a specially threaded barrel which may be expensive or unavailable for a given model of firearm.

Accordingly, there exists a need for a means by which a suppressor can be integrated into the framework of a handgun while enhancing sound-reducing ability in a manner that is affordable, easy, and effective. The development of the bullet suppressor of the present invention fulfills this need.

SUMMARY OF THE INVENTION

The present invention comprises a bullet suppressor, the suppressor comprising a pathway for a bullet, a first lever, the first lever being rotatable about a first axis, the first lever having a top, a bottom, an outer end, and an inner end, wherein, in a first position, the outer end of the first lever extends into the pathway for a bullet such that a bullet travelling through the pathway contacts the outer end of the first lever causing the first lever to rotate in a first direction. The suppressor further comprises a second lever, the second lever being rotatable about a second axis, the second lever having a top, a bottom, an outer end, and an inner end, the second lever beginning in a first position. Furthermore, the inner end of the first lever is in mechanical communication with the outer end of the second lever, the second lever rotating in a second direction as the first lever rotates, the second direction being opposite to the first direction. The second lever then rotates to a second position wherein its outer end becomes flush with a top of the pathway for a bullet, the second lever in the second position becoming a boundary, the boundary trapping exhaust gases exiting a firearm, the exhaust gases trailing the bullet, such that the exhaust gases remain in the suppressor as the bullet exits the suppressor. The first lever and second lever thereafter return to the first position, thus dealying a release of the exhaust gases from the suppressor and causing a decrease in a decibel level of a gunshot.

In some aspects, the suppressor further comprises a first spring, the first spring being compressible, and positioned under the bottom of the outer end of the first lever, the first spring continuously influencing (pushing up on) the first lever to return to its first position.

In some aspects, the suppressor has a stopper, wherein the first lever's rotation in a first direction is stopped by the stopper when the bottom of the outer end of the first lever contacts the stopper.

In some aspects, the suppressor further has a spring-loaded lock for locking the first and second levers in the second position, thus maintaining the exhaust gases within the suppressor. In some aspects, the spring-loaded lock is connected to a fixing member. In some aspects, the spring-loaded lock becomes lodged in a crevice, the crevice being located on the inner end of the second lever, the crevice becoming accessible to the spring-loaded lock when the second lever rotates to the second position.

In some aspects, a recoil and a return of a gun slide of a firearm causes a dislodging of the spring-loaded lock from the crevice, the dislodging causing the first lever and second levers to return to the first position.

In some aspects, the suppressor further has a turning member connected to a sliding member, the turning member being influenced by the sliding member to rotate thus forcing the spring-loaded lock to dislodge from the crevice, the sliding member being influenced by a movement of a gun slide of a firearm.

In some aspects, the suppressor comprises a spring member further connected to the sliding member, wherein the spring member is in contact with the gun slide of a firearm.

An appreciation of other aims and objectives of the present invention and a more complete and comprehensive understanding of this invention may be achieved by referring to the drawings, and by studying the description of preferred and alternative embodiments.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DETAILED DESCRIPTION OF THE PREFERRED EMBODIMENT

In the following description, for purposes of explanation, specific examples are set forth to provide a thorough understanding of the present invention. However, it will be apparent to one skilled in the art that these specific details are not required in order to practice the present invention. The same techniques can easily be applied to other types similar systems.

Figure 1:
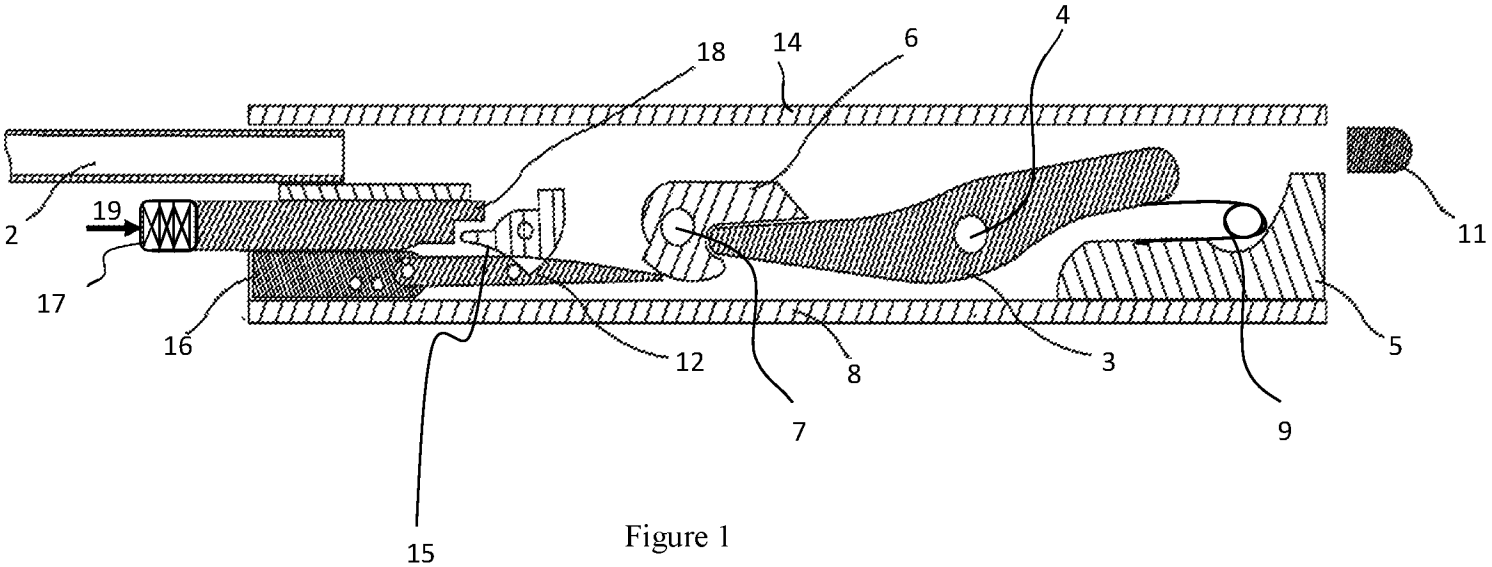
FIG. 1 is a cross-sectional view of a bullet suppressor in a first position according to a preferred embodiment of the present invention.

The best mode for carrying out the invention is presented in terms of its preferred embodiment, herein depicted within FIG. 1. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

Figure 2:
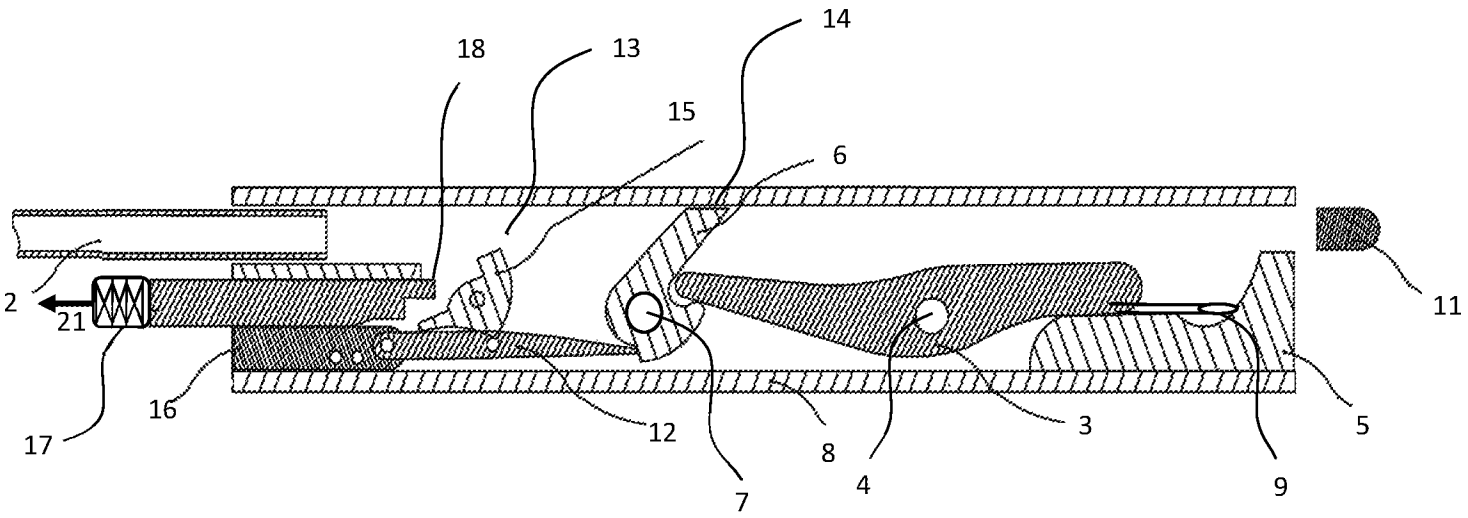
FIG. 2 is a cross-sectional view of a bullet suppressor in a second position according to a preferred embodiment of the present invention.

Referring to FIGS. 1-2, the effect of the invention is to delay the exhaust gas for a short time in the silencer (suppressor) during the shot. By cutting off the gas from the emitted bullet, so that the gas does not exit immediately after the outgoing bullet, the sound associated with the exiting of a bullet is significantly reduced. The delayed release of exhaust gases is caused by the movement and interaction of interior elements within the suppressor connected to a firearm. The suppressor is detachable and re-attachable from a firearm (e.g., via threading).

The mechanism of the present invention shifts from a first position to a second position, each time a bullet 11 travels through a pathway within the suppressor and each time the gun slide 22 of a firearm recoils and returns to its original position. Departing from a firearm barrel 2 during each shot, a bullet 11 travelling through a pathway of the suppressor 8 contacts the top of an outer end of a first lever 3, forcing the first lever 3 to move. The bullet 11 continues to travel through the suppressor, but the bullet's contact as it moves by the first lever 3 begins a movement of the mechanism within the suppressor which traps the exhaust gases trailing the bullet 11. This first lever 3, after influence of the bullet 11 as it moves past the first lever 3, turns about a first fixed axis (first pivot point) 4 until the first lever's movement is stopped when the bottom of the first lever's outer end contacts a stopper 5. The opposite end (i.e. inner end) of the first lever 3, also rotating clockwise, is in mechanical communication and drives a second lever 6, which simultaneously rotates counterclockwise about a second fixed axis (second pivot point) 7 until the second lever's outer end contacts a top part 14 of the pathway of the bullet within the suppressor 8.

The first lever 3 may be under the influence of a first spring 9 which places an upward force on the outer end of the first lever 3, continuously forcing the first lever 3 to return to its initial position (i.e., its first position, shown in FIG. 1). The first spring, e.g., may be coupled to a portion of the stopper 5. The opposite (inner) end of the first lever 3 presses against the bottom of the outer end of the second lever 6. Thus, without the influence of a bullet 11 travelling past the first lever 3, forcing the first lever's rotation in a clockwise direction, the first spring 9 forces the outer end of the first lever 3 to sit partially in the path of a bullet 11 moving through the suppressor 8. When a bullet 11 is fired out of a firearm barrel 2, the bullet travels through the suppressor 8 and contacts the portion of the first lever 3 sitting partially in the bullet pathway thus forcing the first lever 3 to rotate clockwise, compressing the first spring 9, and simultaneously forcing the second lever 6 to rotate counter-clockwise until the second lever's outer end contacts the top 14 of the suppressor 8. After contacting the top 14 of the suppressor 8, the second lever 6 is in a flush position against the top 14 of the suppressor 8, which creates a closed space (boundary) between the barrel of the firearm and the second lever (second position, shown in FIG. 2). After the bullet 11 exits the suppressor 8, although the first spring 9 would influence the levers 3, 6 to return to the first position (as shown in FIG. 1), the first and second levers 3, 6 are locked in the second position 2 by a spring-loaded lock 12, which is connected to a fixing member 16 for fixing the lock 12 at an axis. The spring-loaded lock 12 remains under constant pressure, via a second spring positioned inside the lock (not shown), to push upward on the second lever 6. The spring-loaded lock functions in a manner similar to a spring-loaded gate of a commonly known carabiner. Thus, when the second lever 6 rotates counterclockwise, the outer end of the spring-loaded lock 12 becomes lodged in a crevice at the inner end of the second lever 6, locking the second lever 6 and first lever 3 in the first position. The crevice becomes available to the spring-loaded lock 12 only when the second lever 6 rotates into the second position. Therefore, the exhaust gases from a shot become trapped in a closed space 13 formed behind the emitted bullet as the levers 3, 6 rotate into and remain in the second position. The closed space 13 is bound by the top 14 of the suppressor, the bottom of the suppressor, and the second lever 6, as well as the spring-loaded lock 12, if employed. The force from the first spring 9 on the first lever 3, which would cause the levers 3, 6 to turn in an opposite direction and back to the first position, is counteracted by the spring-loaded lock 12 as long as it remains lodged in the crevice at the inner end of the second lever 6.

As the gun slide 22 recoils 21 and returns 19 to its original position, the spring-loaded lock 12 is forced downward and out of the crevice of the second lever 6 thus releasing its lock on the second lever 6. This occurs via a mechanism comprising a turning element (turning member) 15 connected to a sliding element (sliding member) 18, the sliding element being connected to a third spring 17 (the third spring 17 is optional). When the gun slide 22 of a firearm recoils, creating a movement in the direction 21 the sliding element is not under influence of force from the gun slide. When the gun slide returns, it contacts the sliding element 18 (optionally, via the third spring 17, if present), creating a force in the direction 19 and forcing the sliding element 18 to move forward, which in turn forces the turning element 15 to turn in a clockwise direction about its center, in turn forcing the spring-loaded lock 12 downward, thus releasing the second lever 6. Then, along with the first lever 3, the second lever 6 returns to the first position under influence of the first spring 9. It is noted that this is but one example of a means for releasing the spring-loaded lock 12 from the crevice of the second lever 6.

Therefore, the gases are delayed for a short period of the gun slide's movement back and then forward. As soon as the gun slide completes its recoil, the suppressor releases the accumulated gases, allowing them to exit after the bullet is fired. Because the gases are not released instantaneously and are instead delayed by the movement of the levers backwards and forwards, the loudness (decibel level) associated with the release of gases is significantly reduced. In other words, due to this mechanism, the release of exhaust gases is significantly slowed and because the gases do not exit instantly behind the bullet, the sound associated with exhaust gases is significantly decreased.

Figure 3:
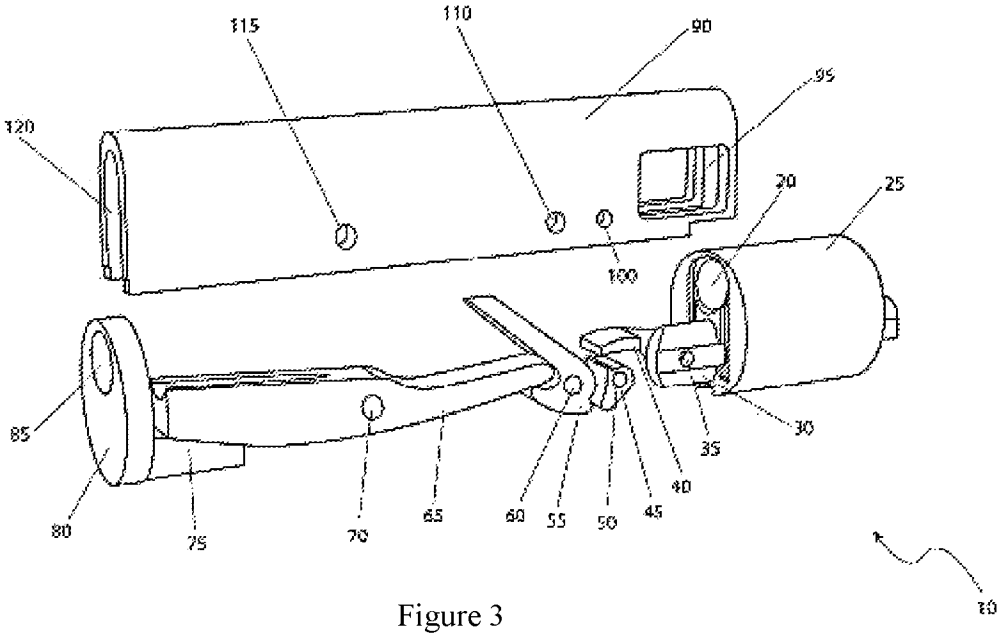
FIG. 3 is a perspective view of another embodiment of a bullet suppressor according to the present invention.
Figure 4:
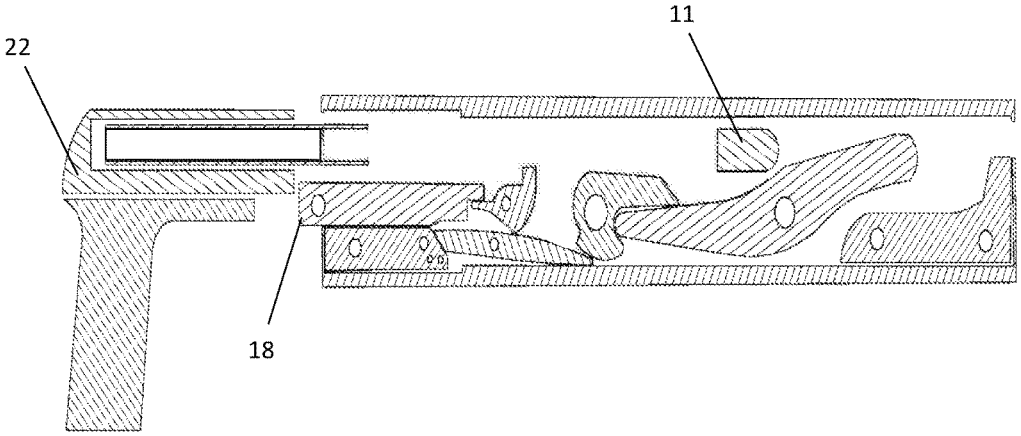
FIG. 4 is a cross-sectional view of a bullet suppressor according to the present invention connected to an exemplary firearm.

Another embodiment of the suppressor is shown in FIG. 3. Referring now to FIG. 5, a perspective view of a bullet suppressor 10, according to another embodiment of the present invention is disclosed (herein described as the "device") 10. The device 10, has the general appearance of an upper portion of a 1911-style handgun. The device 10 comprises a first barrel 20 disposed within a first bushing 25 and a second barrel 85 disposed within a second bushing 80. Secured between the first bushing 25 and the second bushing 80 is a slide 90. The slide 90 has an inverted "U"-shaped cross-section comprising a slide interior chamber 120. The slide 90 has a safety catch actuator access 95 adjacent a first end of the slide and adjacent the first bushing 25. The safety catch actuator access 95 permits access to a safety catch actuator 30 disposed within the slide 90 and in mechanical communication with a first end of the first bushing 25.

The safety catch actuator is in mechanical communication with a safety catch 40 by a pin (not shown) removably inserted into a safety catch actuator pin aperture 35. The safety catch 40 is in mechanical communication with a first pivot plate 45 which is secured in place by a pin (not shown) removably inserted into a first slide aperture 100 and into an aligned first pivot plate aperture 50 thereby moveably securing the first pivot plate 45 within the slide 90. The first pivot plate 45 is in turn in mechanical communication with a second pivot plate 55 which is secured in place by a pin (not shown) removably inserted into an aligned second slide aperture 110 and into a second pivot plate aperture 60 thereby moveably securing the second pivot plate 55 within the slide 90. The second pivot plate 55 is in turn in mechanical communication with a third pivot plate 65 which is secured in place by a pin (not shown) removably inserted into a third slide aperture 115 and into an aligned third pivot plate aperture 70 thereby moveably securing the third pivot plate 65 within the slide 90.

The first pivot plate 45, second pivot plate 55 and third pivot plate 65 are configured to act as cantilevers with respect to each other. When the safety catch 40 is not mechanically engaged with the first pivot plate 45, the second pivot plate 55 and third pivot plate 65 are free to reciprocally lever up or down. When a first bullet (not shown) is fired from the device 10, having the safety catch 40 not engaged, the first bullet (not shown) passes out of the interior end of the first barrel 20, travels through a first portion of the interior slide chamber 120 and encounters an upper portion of the third pivot plate 65. Upon impacting the upper portion of the third pivot plate 65, the force from the first bullet (not shown) pushes the upper portion of the third pivot plate 65 downward thereby necessitating the upward movement of an upper portion of the second pivot plate 55. As the first bullet (not shown) exits the second barrel 85, explosive gases traveling behind the first bullet (not shown) become trapped behind the upper portion of the second pivot plate 55. The trapping of the explosive gases from the first bullet (not shown) prevents the explosives gases from immediately exiting the device 10 through the second barrel 85. This effect acts to suppress the decibel level of the device 10 when fired.

When a second bullet (not shown) is fired from the device 10, having the safety catch 40 not engaged, the second bullet (not shown) passes out of the interior end of the first barrel 20, travels through the first portion of the interior slide chamber 120 and encounters the now raised upper portion of the second pivot plate 55. Upon impacting the now raised upper portion of the second pivot plate 55, the force from the second bullet (not shown) pushes the upper portion of the second pivot plate 55 downward thereby necessitating the upward movement of the upper portion of the third pivot plate 65. The second bullet (not shown) then travels through a second portion of the interior slide chamber and encounters the now raised upper portion of the third pivot plate 65. Upon impacting the upper portion of the third pivot plate 65, the force from the second bullet (not shown) pushes the upper portion of the third pivot plate 65 downward thereby necessitating the upward movement of the upper portion of the second pivot plate 55.

As the second bullet (not shown) exits the second barrel 85, explosive gases traveling behind the second bullet (not shown) once again become trapped behind the upper portion of the second pivot plate 55. As with the first bullet (not shown), the trapping of the explosive gases from the second bullet (not shown) prevents the explosives gasses from immediately exiting the device 10 through the second barrel 85. This effect acts to once again suppress the decibel level of the device 10 when fired. This series of reciprocal events occurs with the firing of each successive bullet from the device 10.

The safety catch 40 when depressed into mechanical communication by actuation of the safety catch actuator 30 acts to prevent the free movement of the first pivot plate 45, which in turn prevents the free movement of the second pivot plate 55, which in turn prevents the free movement of the third pivot plate 65. Having been so engaged, the safety catch prevents the operation of the device 10.

Listing of reference numerals in FIG. 3:

10 bullet suppressor
20 first barrel
25 first bushing
30 safety catch actuator
35 safety catch actuator pin aperture
40 safety catch
45 first pivot plate
50 first pivot plate aperture
55 second pivot plate
60 second pivot plate aperture
65 third pivot plate
70 third pivot plate aperture
75 second bushing rest plate
80 second bushing
85 second barrel
90 slide
95 safety catch actuator access
100 first slide aperture
110 second slide aperture
115 third slide aperture
120 slide interior chamber The preferred embodiment of the present invention can be utilized by the common user in a simple and effortless manner with little or no training. It is envisioned that the device 10 would be constructed in general accordance with the figures utilizing commonly accepted gunsmithing and gun manufacturing techniques. It is envisioned that the device 10, once procured by a user, could be loaded and fired utilizing any caliber of bullet (not shown).

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The description of a preferred embodiment of the invention has been presented for purposes of illustration and description. It is not intended to be exhaustive or to limit the invention to the precise forms disclosed. Obviously, many modifications and variations will be apparent to practitioners skilled in this art. It is intended that the scope of the invention be defined by the following claims and their equivalents.

Moreover, the words "example" or "exemplary" are used herein to mean serving as an example, instance, or illustration. Any aspect or design described herein as "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

What is claimed is:

1. A bullet suppressor, comprising:

a pathway for a bullet, a first lever, the first lever being rotatable about a first axis, the first lever having a top, a bottom, an outer end, and an inner end, wherein, in a first position, the outer end of the first lever extends into the pathway for a bullet such that a bullet travelling through the pathway contacts the outer end of the first lever causing the first lever to rotate in a first direction, a second lever, the second lever being rotatable about a second axis, the second lever having a top, a bottom, an outer end, and an inner end, the second lever beginning in a first position, wherein the inner end of the first lever is in mechanical communication with the outer end of the second lever, the second lever rotating in a second direction as the first lever rotates, said second direction being opposite to said first direction, wherein the second lever rotates to a second position wherein its outer end becomes flush with a top of the pathway for said bullet, the second lever in the second position becoming a boundary, the boundary trapping exhaust gases exiting a firearm, the exhaust gases trailing the bullet, such that the exhaust gases remain in the suppressor as the bullet exits the suppressor, and wherein the first lever and second lever thereafter return to the first position, thus delaying a release of the exhaust gases from the suppressor and causing a decrease in a decibel level of a gunshot.

2. The suppressor of claim 1, further comprising:

a first spring, said first spring being compressible, said first spring being positioned under the bottom of the outer end of the first lever, said first spring continuously influencing the first lever to return to its first position.

3. The suppressor of claim 1, further comprising:

said stopper, wherein the first lever's rotation in said first direction is stopped when the bottom of the outer end of the first lever contacts a stopper.

4. The suppressor of claim 2, further comprising:

a spring-loaded lock for locking the first and second levers in the second position, thus maintaining the exhaust gases within the suppressor.

5. The suppressor of claim 4, wherein the spring-loaded lock is connected to a fixing member.

6. The suppressor of claim 4, wherein the spring-loaded lock becomes lodged in a crevice, the crevice being located on the inner end of the second lever, the crevice becoming accessible to the spring-loaded lock when the second lever rotates to the second position.

7. The suppressor of claim 6, wherein a recoil and a return of a gun slide of a firearm causes a dislodging of the spring-loaded lock from the crevice, the dislodging causing the first lever and second levers to return to the first position.

8. The suppressor of claim 6, further comprising:

a turning member connected to a sliding member, the turning member being influenced by the sliding member to rotate thus forcing the spring-loaded lock to dislodge from the crevice, the sliding member being influenced by a movement of a gun slide of a firearm.

9. The suppressor of claim 8, further comprising:

a spring member further connected to the sliding member, wherein the spring member is in contact with the gun slide of said firearm.

* * * * *